US006326721B1

(12) United States Patent
Shippee et al.

(10) Patent No.: US 6,326,721 B1
(45) Date of Patent: Dec. 4, 2001

(54) HID LAMP HAVING ARC TUBE MOUNTING FRAME WHICH RELIEVES THERMAL STRESS

(75) Inventors: Daniel P. Shippee, Hammondsport, NY (US); Gregory J. Nelson, Eindhoven (NL); Franciscus H. van Lierop, Bath, NY (US); Kevin D. Provagna, Medina; James M. Gensert, Litchfield, both of OH (US)

(73) Assignee: Philips Electronics North America Corp., New York, NY (US)

( * ) Notice: Subject to any disclaimer, the term of this patent is extended or adjusted under 35 U.S.C. 154(b) by 0 days.

(21) Appl. No.: 09/245,756

(22) Filed: Feb. 8, 1999

(51) Int. Cl.[7] ..... H01J 61/52

(52) U.S. Cl. ..... 313/283; 313/25; 313/634; 313/239; 313/292

(58) Field of Search ..... 313/25, 634, 283, 313/239, 292

(56) References Cited

U.S. PATENT DOCUMENTS 3,898,507 * 8/1975 Bolt et al. ..... 313/323
4,401,913 * 8/1983 Koza et al. ..... 313/25
5,698,947 12/1997 Choi ..... 313/623

FOREIGN PATENT DOCUMENTS 440138 10/1934 (GB) .

* cited by examiner

*Primary Examiner*—Frank G. Font
*Assistant Examiner*—Andrew Lee
(74) *Attorney, Agent, or Firm*—F. Brice Faller

(57) ABSTRACT

An HID lamp utilizes a wire frame member having an integral coil with spaces between windings to relieve thermal stress and provide shock absorption in a ceramic metal halide discharge lamp mounted concentrically in an elliptical-dimple (ED-type) glass envelope. The wire frame member has a first end welded to a current carrying support member embedded in the stem and a second end welded to an upper axial lead of the arc tube, the coil being situated about the dimple. The lower axial lead fixed relative to a second current carrying support member embedded in the stem, so that the coil compresses when the arc tube expands relative to the wire frame member.

9 Claims, 3 Drawing Sheets

HID LAMP HAVING ARC TUBE MOUNTING FRAME WHICH RELIEVES THERMAL STRESS

BACKGROUND OF THE INVENTION

The present invention relates to a high intensity discharge (HID) lamp, of the type having a ceramic metal halide arc tube having opposed axial leads connected to current carrying support members embedded in a glass stem, and a glass envelope having a closed end opposite from the stem.

FIG. 1 shows a known ceramic metal halide discharge lamp having a metal base 10 and a center contact 12 soldered to respective current inputs 16, 17 embedded in a glass stem 14, where they are welded to support members 60, 61. The first support member 60 has an upper end provided with a loop 64 positioned around a protrusion formed by dimple 24 in closed end 22 of outer envelope 20, and a lateral arm 62 welded to a first axial lead 38 of arc tube 30. This is known as an elliptical dimple (ED-type) lamp. The second support member 61 is connected to the second axial lead 39 of arc tube 30 by means of a flexible niobium C hook 66 welded in place. The hook relieves stress that would otherwise be experienced by the arc tube due to expansion and contraction along its axis. The extended sleeves 36, 37 of the arc tube are particularly sensitive to shearing stresses (torque perpendicular to the long axis of the arc tube). However the hook has an inherent material cost as well as the cost of labor to weld it in place. Further, both the arm 62 and the hook 66 can bend if the lamp is dropped, putting the arc tube 30 off center in the envelope, and likewise off center with respect to a reflector in a lighting fixture. This is especially troublesome with a parabolic reflector, which requires that the light source be at the focal point of the parabola.

U.S. Pat. No. 3,906,275 discloses an ED-type lamp with a quartz metal-halide discharge tube held by straps clamping the opposed pinches and fixed to respective mounting members embedded in the stem. Thermal stresses are not a problem for this type of lamp due to the robust character of the quartz envelope, and the relatively low coefficient of thermal expansion of quartz, $5.5\times10^{-7}$ per ° C.

U.S. Pat. No. 4,401,913 discloses high pressure sodium ED-type lamp having a polycrystalline alumina (PCA) ceramic arc tube. The lower terminal is secured to a rod in the stem, and the upper terminal is secured to a rod having an upper end with a helical spring engaging the dimple. The spring compresses to absorb linear expansion of the arc tube, which can be significant due to its length (11 cm), its coefficient expansion ($80\times10^{-7}$ per ° C.), and high temperatures. Electrical current is provided to the upper terminal by a fine helically bent wire, known as a flying lead, which does not provide any support. The upper end of the arc tube is supported exclusively by the spring engaging the dimple, so that expansion relative to a support frame is not a problem.

SUMMARY OF THE INVENTION

An object of the invention is to relieve thermal stress on an arc tube having opposed axial leads mounted to current carrying support members. A further object is to provide shock absorption to prevent bending of support elements in the event the lamp is dropped.

The lamp according to the invention has a wire frame member with a first end fixed to a first current carrying support member embedded in the stem, a second end fixed to a first axial lead which is adjacent the closed end of the glass envelope, and a coil between the ends, the coil having windings with gaps therebetween.

The wire frame member is especially useful in an ED (elliptical dimple) type lamp, wherein the coil surrounds the protrusion formed by the dimple. A first intermediate portion of the frame member extends from the first end to the coil, and a second intermediate portion extends from the coil to the second end. Welds join the ends to the first support member and the first axial lead, and the second axial lead is substantially fixed with respect to the second support member. The coil therefore compresses to shrink the gaps when the arc tube expands relative to the frame member.

Note that the coil is preferably fitted loosely about the dimple so that it positions the arc tube concentrically within the elliptical outer envelope, but does not press against the closed end of the envelope. Rather, the first intermediate portion is in tension when the coil is in compression.

The coiled spring design has the advantage that no perpendicular torques are generated when the spring is compressed. In contrast, when the C hook is compressed, part of the reaction force generates a torque perpendicular to the long axis of the arc tube, which can lead to cracking the PCA and shortened lamp life. So the stress relief of the invention is superior to that of the prior art in FIG. 1.

Since the glass envelope does provide a support function (lateral positioning), the wire frame member can be lighter gauge than a fully self supporting frame. In a preferred embodiment, the frame member is 0.037 in. diameter spring temper stainless steel, which is lighter and easier to form than the 0.060 in. support member of the prior art, which also forms the truncated support member of the present invention.

The wire frame member with integral stress relief is especially suitable for a ceramic metal halide discharge tube with a polycrystalline alumina envelope forming a central barrel defining an arc space, and opposed sleeves which seal the axial leads to the electrodes. While not especially long—typically about 36 mm—its fragility necessitates relieving stress imposed by expansion due to the high operating temperature.

In addition to relieving thermal stress, the coil also provides good shock absorption in all directions in the event the lamp is dropped or otherwise jarred. This assures that mounting components do not readily bend and throw the light source off center in the outer envelope.

The wire frame member also facilitates automated assembly of the lamp, since it is not necessary to manually handle a niobium C hook. Rather, the frame member and arc tube are jigged and welded to the support members embedded in the stem.

These and other advantages of the invention will be apparent with reference to the drawings and the detailed description.

DETAILED DESCRIPTION OF THE PREFERRED EMBODIMENT

Figure 1:
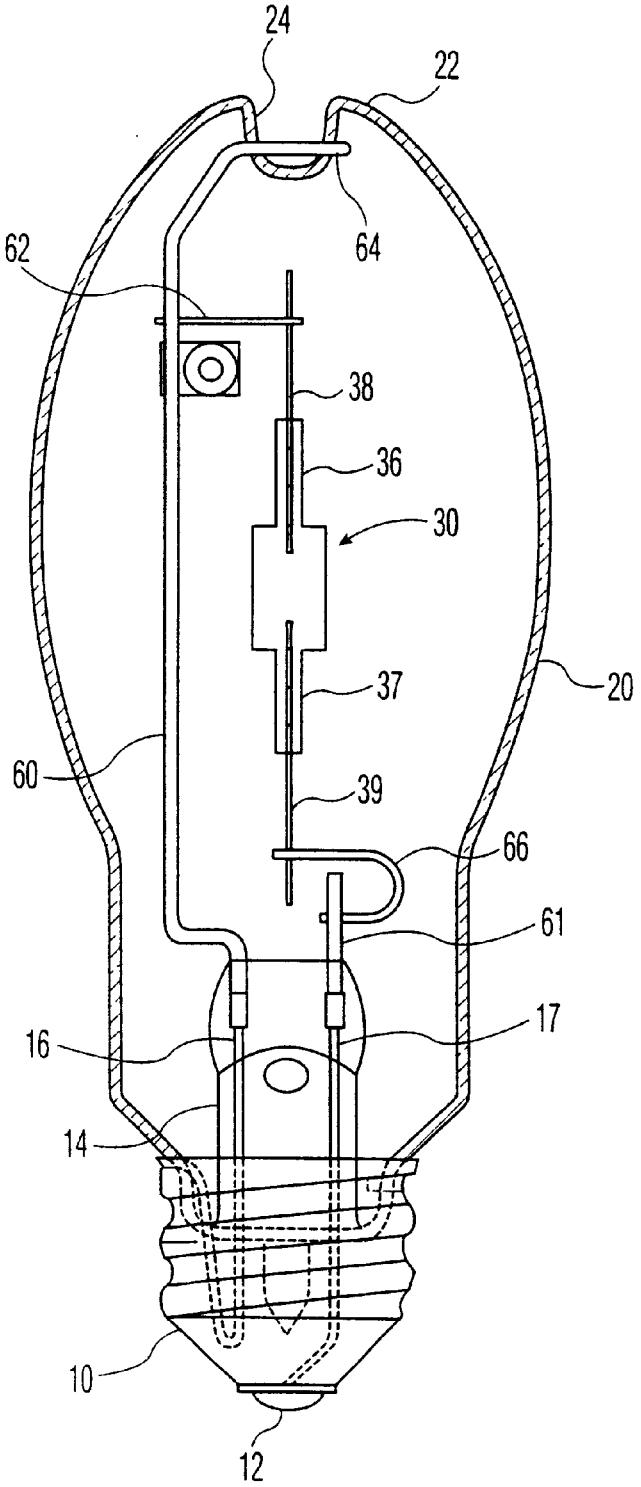
FIG. 1 (PRIOR ART)
FIG. 1 is a side view of the ceramic metal halide lamp of the prior art.
Figure 2:
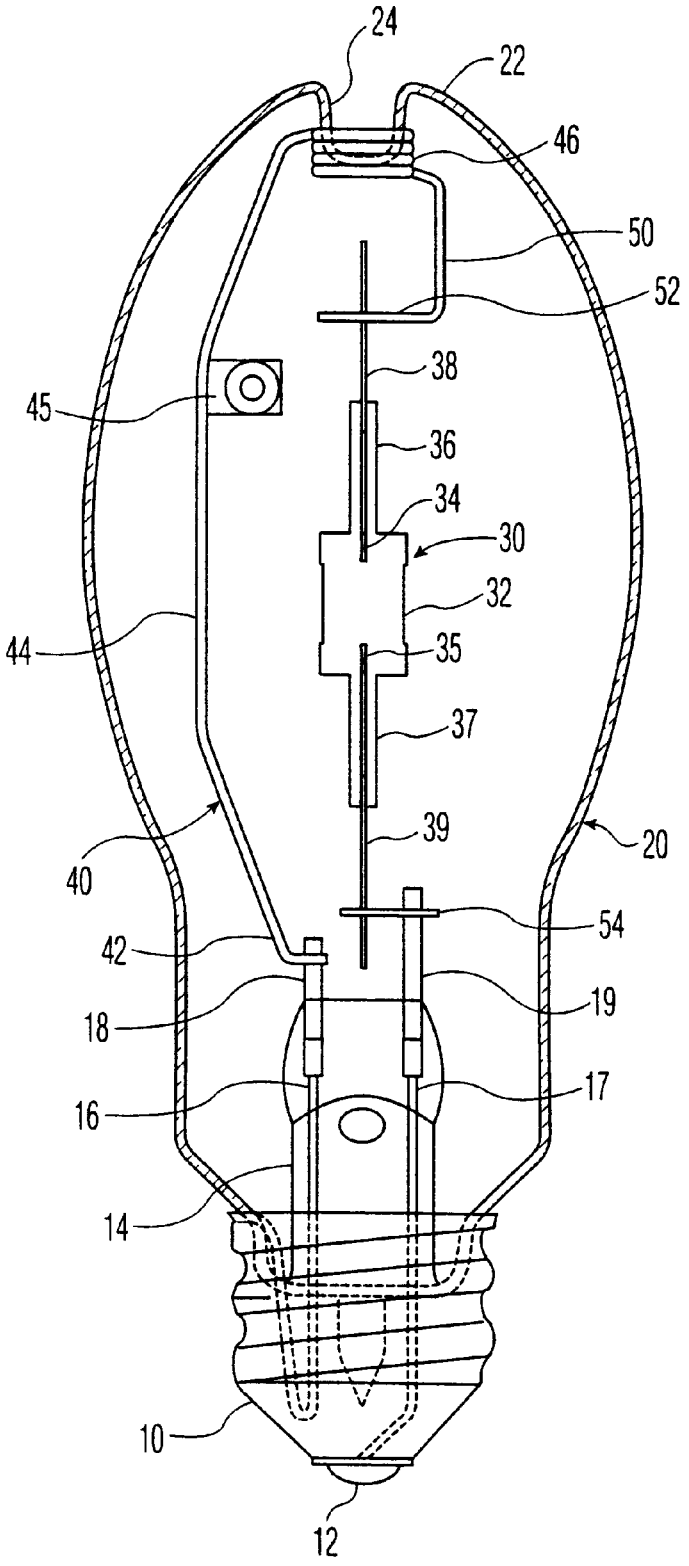
FIG. 2 is a side view of a ceramic metal halide lamp according to the invention.

Referring to FIG. 2, a ceramic metal halide discharge lamp according to a preferred embodiment of the invention has a screw base 10 and a center contact 12 connected to respective first and second current inputs 16, 17, which are embedded in glass stem 14 where they are connected to respective first and second current carrying support members 18, 19 which protrude from the stem 14. The members 18, 19, like the members 60, 61 of the prior art (FIG. 1), are formed of 0.060 in. diameter nickel wire. A glass envelope 20 sealed to the stem 14 has a generally elliptical shape and a closed end 22 provided with a dimple 24 which forms a protrusion.

The light source is an arc tube 30 having a PCA ceramic barrel 32 with electrodes 34, 35 connected to respective opposed axial leads 38, 39 which are sealed in respective ceramic sleeves 36, 37 formed on the barrel 32. A wire frame member 40 has a first end 42 welded to the first support member 18, a second end 52 welded to the first axial lead 38, and a coil 46 between the ends. A first intermediate portion 44 extends from the first end 42 to the coil 46 and has a getter 45 fixed thereto. A second intermediate portion 50 extends from the coil 46 to the second end 52, and the coil 46 loosely surrounds part of the protrusion formed by dimple 24 to position the frame member 40 and the arc tube 30. The second axial lead 39 of the arc tube 30 is welded to a lateral arm 54 which in turn is welded to the second support member 19 whereby the lead 39 is substantially fixed with respect to the second support member 19.

Figure 3:
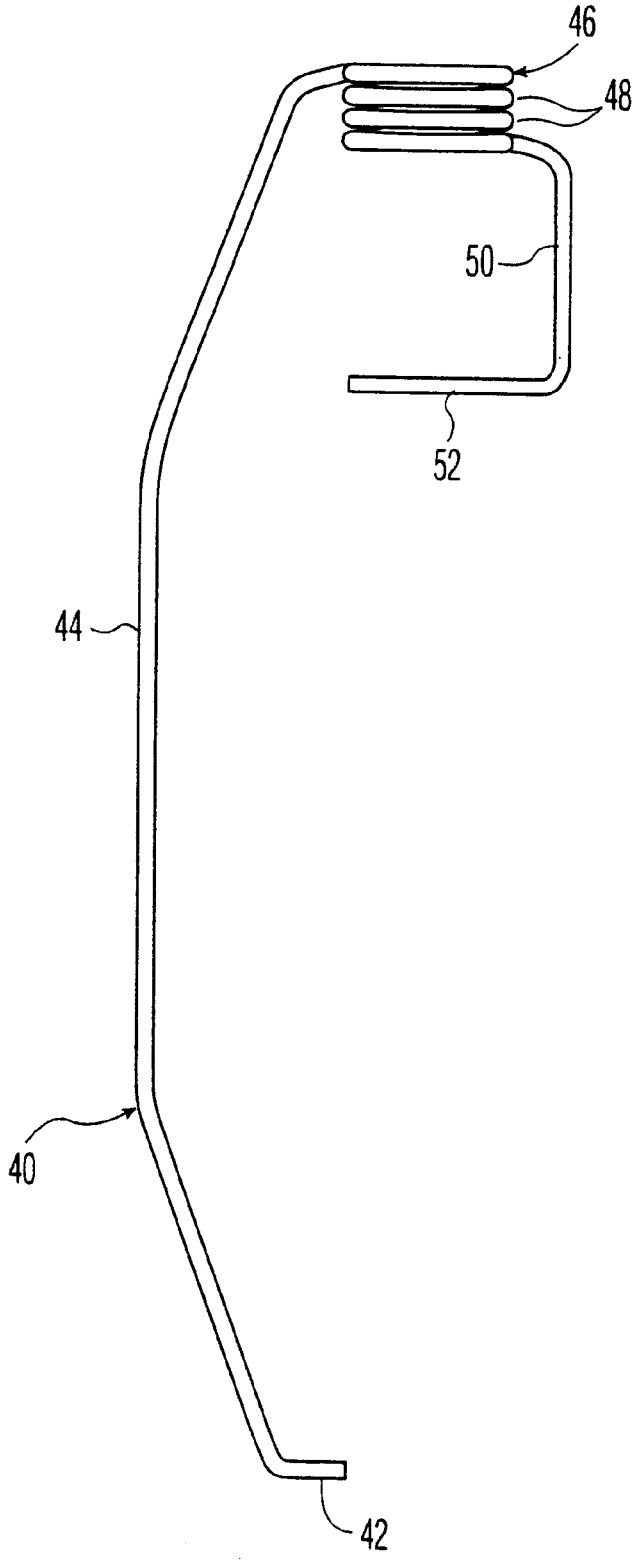
FIG. 3 is a side view of the wire frame member.

Referring also to FIG. 3, the wire frame member 40 is formed from 0.037 in. diameter spring temper nickel plated stainless steel, or 0.037 in. diameter ¼ hard 302 SS. The coil 46 is formed by windings 48 having a gap of about 0.015 in. between windings. This compensates for differences in thermal expansion and contraction between the arc tube 30 and the frame member 40, and permits a simple mechanized assembly procedure.

Assembly entails welding the arc tube leads 38, 39 to the frame member 40 and the lateral arm 54, followed by welding the end 42 and the arm 54 to support members 18, 19, which are already embedded in the stem 14. The pre-formed envelope 20 is then sealed to the stem 14 with the protrusion 24 received in the coil 46, and the cap 10 and contact 12 are fitted and soldered to leads 16, 17.

The lamp according to the invention thus relieves thermal stress in the arc tube 30 by simple mechanism incorporated in the wire frame member 40, and eliminates the need for a separate expansion piece such as the "C" hook of the prior art.

The foregoing is exemplary and not intended to limit the scope of the claims which follow.

What is claimed is:

1. A lamp comprising a light source having opposed first and second axial leads, a glass stem, first and second support members embedded in said stem for supplying electrical current to respective first and second axial leads, a glass envelope surrounding said light source and fixed to said stem, said envelope having a closed end opposite from said stem, said closed end being proximate to said first axial lead, said stem being proximate to said second external lead, and a wire frame member having a first end fixed to said first support member, a second end fixed to said first axial lead, and a coil between said ends, said coil comprising windings with gaps therebetween.

2. A lamp as in claim 1 wherein said lamp envelope has a dimple at said closed end, said dimple forming a protrusion extending toward said first axial lead of said light source, said coil surrounding at least part of said protrusion.

3. A lamp as in claim 2 where said frame member comprises a first intermediate portion extending from said first end to said coil, and a second intermediate portion extending from whereby said coil is in compression when said light source expands relative to said frame member.

4. A lamp as in claim 1 where said light source is an arc tube having a pair of internal electrodes which are connected to respective axial leads.

5. A lamp as in claim 4 wherein said arc tube has a ceramic envelope.

6. A lamp as in claim 5 wherein the ceramic envelope is polycrystalline alumina.

7. A lamp comprising a light source having opposed first and second axial leads, a glass stem, first and second support members embedded in said stem for supplying electrical current to respective first and second axial leads, a glass envelope surrounding said light source and fixed to said stem, said envelope having a closed end opposite from said stem and having a dimple at said closed end, said closed end being proximate to said first axial lead of said light source, and said dimple forming a protrusion extending toward said first axial lead, said stem being proximate to said second external lead, and a wire frame member having a first end fixed to said first support member, a second end fixed to said first axial lead, and a coil between said ends, said coil comprising windings with gaps therebetween, said coil fitting loosely about said protrusion and being free from pressure against the closed end of the envelope.

8. A lamp as in claim 7 where said frame member comprises a first intermediate portion extending from said first end to said coil, and a second intermediate portion extending from said coil to said second end, said second axial lead being substantially fixed with respect to said second support member, whereby said first intermediate portion is in tension and said coil is in compression when said light source expands relative to said frame member.

9. A lamp as in claim 7 where said frame member is formed of a wire having a diameter less than the diameter of said support members.

* * * * *